United States Patent [19]

Wein

[11] Patent Number: 4,795,085

[45] Date of Patent: Jan. 3, 1989

[54] FOLDING BOX CONSTRUCTION

[76] Inventor: Sam Wein, P.O. Box 1085, La Mirada, Calif. 90637

[21] Appl. No.: 43,883

[22] Filed: Apr. 29, 1987

[51] Int. Cl.[4] ..... B65D 5/36

[52] U.S. Cl. ..... 229/41 B; 229/41 R; 229/23 BT

[58] Field of Search ..... 229/41 R, 41 B, 23 BT, 229/19, DIG. 9, 125.01, 125.08; 220/4 E, 4 B

[56] References Cited

U.S. PATENT DOCUMENTS

| | | | |
|---|---|---|---|
| 1,311,047 | 7/1919 | Cole | 229/41 B |
| 1,357,519 | 11/1920 | Russell . | |
| 1,738,744 | 12/1929 | Walter | 229/41 B |
| 2,141,438 | 12/1938 | Hirsch | 229/41 B |
| 2,581,105 | 1/1952 | Hunsworth | 229/23 |
| 2,620,117 | 12/1952 | Nemoede | 229/30 |
| 2,650,751 | 9/1953 | Goers | 229/41 B |
| 2,936,941 | 5/1960 | Lewis | 229/23 |
| 4,474,324 | 10/1984 | Forbes, Jr. | 229/23 |
| 4,531,669 | 7/1985 | Osborne | 229/45 |

FOREIGN PATENT DOCUMENTS

| | | | |
|---|---|---|---|
| 391557 | 5/1933 | United Kingdom | 229/41 R |

*Primary Examiner*—Willis Little

*Attorney, Agent, or Firm*—Gausewitz, Carr & Rothenberg

[57] ABSTRACT

A folding box is constructed in which there are end flaps on certain of the edge panels glued to adjacent edge panels so that the end flaps have free bottom edges. When folded, the edge panels overlie a central panel and the end flaps fit beneath certain edge panels with their bottom edges at the bases of the bends. When unfolded, the edge panels are held in an upstanding relationship with the central panel by the bottom edges of the end flaps. Reverse scores are provided to enable bending of the edge panels from which the end flaps project. As a result, there is no protrusion into the base of the bend and it is not necessary to recess the bottom edges of the end flaps, so that the latter can support the edge panels in a nearly perpendicular relationship with the central panel.

11 Claims, 4 Drawing Sheets

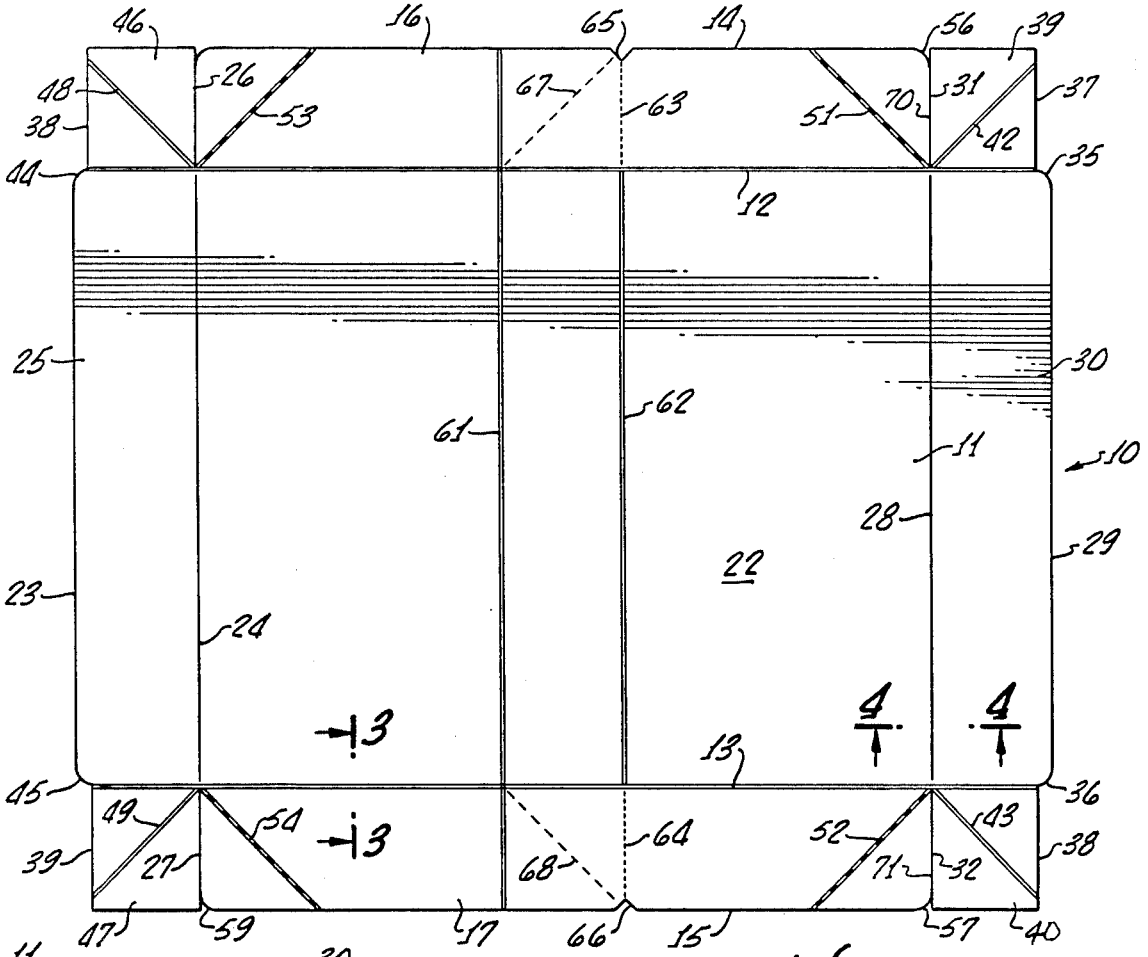
FIG. 1.
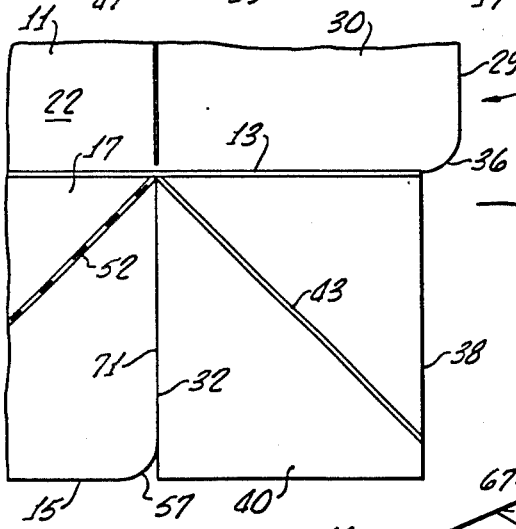
FIG. 2.
FIG. 5.
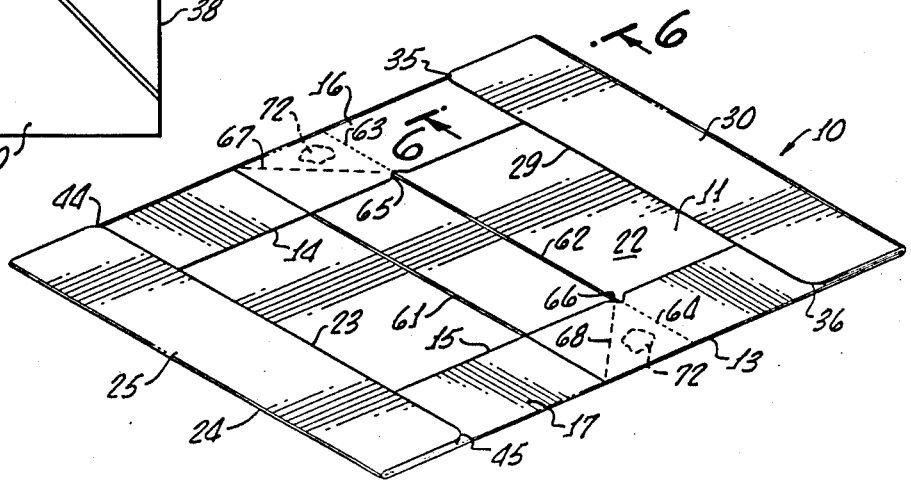

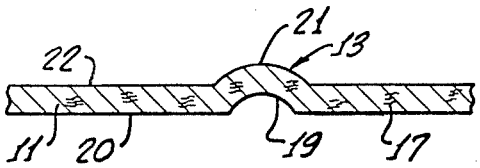
FIG. 3.
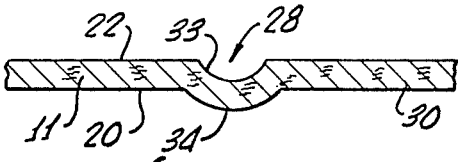
FIG. 4.
FIG. 8.
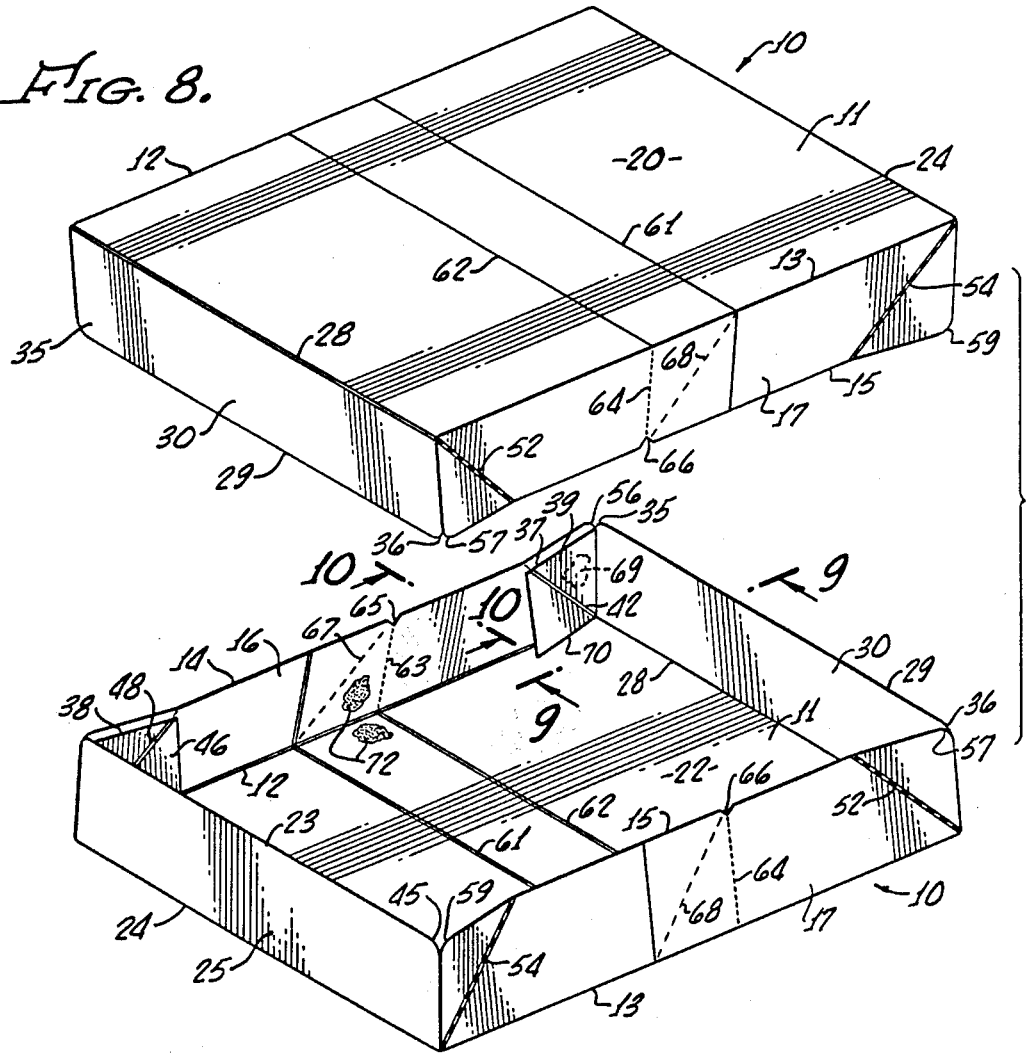
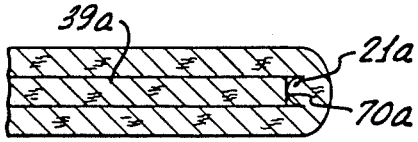
FIG. 7.
(PRIOR ART)
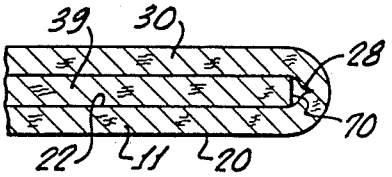
FIG. 6.

FOLDING BOX CONSTRUCTION

BACKGROUND OF THE INVENTION

Gift boxes usually are made of cardboard and arranged so that they are folded flat prior to use. This is important in minimizing space requirements for shipment and storage. The boxes are formed as identical units that are fitted together, one to form the lid and the other the receptacle portion of the box. Each unit is made of a sheet of cardboard having a rectangular bottom panel with edge panels doubled over the bottom panel when the box unit is folded. The ends of the edge panels are connected by end flaps on one opposite pair of the end panels, which are joined by an adhesive to the adjacent ends of the other pair of edge panels. When the box is unfolded and the edge panels moved to an upright position relative to the bottom panel, the bottom edges of the end flaps engage the bottom panel, thereby providing support to the edge panels. Without this support, the edge panels would not remain erect and would collapse back inwardly toward the bottom panel.

Undesirably, however, the bottom edges of the end flaps must be recessed, so that they allow an excessive inward inclination of the edge panels. In other words, as conventionally supported by the end flaps, the edge panels are far from being perpendicular to the bottom panel. This causes difficulty in placing the contents into the box, as well as detracting from the appearance of the box and adding to the complexity of fitting the two box units together.

The recessing of the bottom edges of the end flaps comes about because of the scores at the intersections of the edge panels and the bottom panels. Scores are necessary so that straight bends can be formed when the edge panels are deflected to the folded position, as well as to the upstanding position for the completed box. These scores are made by steel rule dies which distend the material of the box upwardly as ridges along the surface of the bottom panel against which the edge panels are bent. A corresponding groove is formed in the opposite side of the board along each of the score lines. As a result, when the edge panel is bent relative to the bottom panel, the ridge protrudes into the space between the two at the base of the bend. In the folded box, the end flaps must fit within this space. Because of the presence of protrusions formed by the ridges of the scores, the bottom edges of the end flaps must be recessed sufficiently to provide clearance. This recessing is enough to prevent the end flaps from supporting the edge panels in anything approximating a perpendicular position relative to the bottom panel.

SUMMARY OF THE INVENTION

The present invention overcomes the difficulties in the prior art, providing an improved support for the edge panels of the box so that they approach a perpendicular relationship relative to the bottom panel. In accordance with the present invention, it is not necessary to recess the bottom edges of the end flaps as in prior art constructions. This is accomplished by providing reverse scores along the bend lines for the edge panels under which the end flaps fit when the box is folded. The reverse score preferably extends the entire length of the edge, although it may be localized at the area where the end flaps are present, if desired. The reverse score provides the groove of the score on the side over which the edge panels are bent and the ridge on the opposite side. Consequently, when the edge panels are bent over the bottom panel, there is no ridge to protrude into the space between the edge panels and the bottom panel. This enables the bottom edge of the end flap to be extended into the base of the bend. With the bottom edge being extended in this manner, it provides a better support for the edge panels when the box later is unfolded. Hence, the edge panels which form the sidewalls of the box are opened more fully, making the box easier to use and of better appearance.

In addition, the end flaps are provided with diagonal scores which allow them to be deflected under certain circumstances. This may occur when a box unit has been unfolded only for it to be found that it is not needed at that time. It is thereupon necessary to refold the box for storage. When this is done, it is difficult to deflect the end flaps under the appropriate edge panels in the folding operation without bending the end flaps and forming creases in them. This destroys the strength of the end flaps and hence their usefulness. This means that the box unit then must be discarded. In the present invention there are diagonal scores on the edge flaps, allowing them to deflect slightly as the box is refolded, directing them into the space under the appropriate end panels so that the box is refolded without damage.

Other features of the invention include rounded notches at the exposed corners of the box unit, which facilitates telescoping one box unit over the other as the box is assembled.

This invention is applicable to the construction of ordinary boxes or variable-size boxes of the type disclosed in my prior U.S. Pat. No. 4,452,367. When the latter box is produced, notches are provided at the ends of the perforations used in tearing the sidewalls to facilitate that operation when forming a small-size box.

BRIEF DESCRIPTION OF THE DRAWINGS

FIG. 1 is a plan view of a sheet of board prepared for construction of a box unit;

FIG. 2 is an enlarged fragmentary plan view of a portion of the box unit;

FIG. 3 is an enlarged fragmentary sectional view taken along line 3—3 of FIG. 1;

FIG. 4 is an enlarged fragmentary sectional view taken along line 4—4 of FIG. 1;

FIG. 5 is a perspective view of the box unit in its folded condition;

FIG. 6 is an enlarged fragmentary sectional view taken along line 6—6 of FIG. 4;

FIG. 7 is an enlarged fragmentary sectional view illustrating a prior art construction;

FIG. 8 is a perspective view of two of the box units unfolded and prepared for assembly as a completed box;

DETAILED DESCRIPTION OF THE INVENTION

Figure 9:
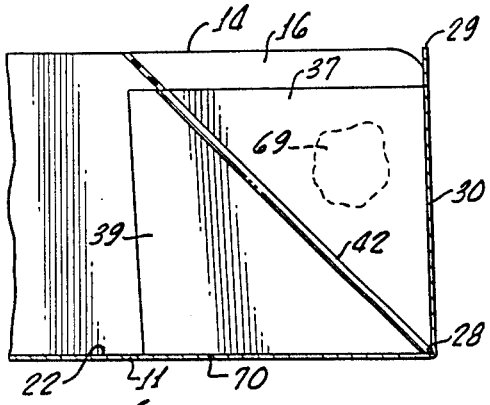
FIG. 9 is an enlarged fragmentary sectional view taken along line 9—9 of FIG. 8.
Figure 10:
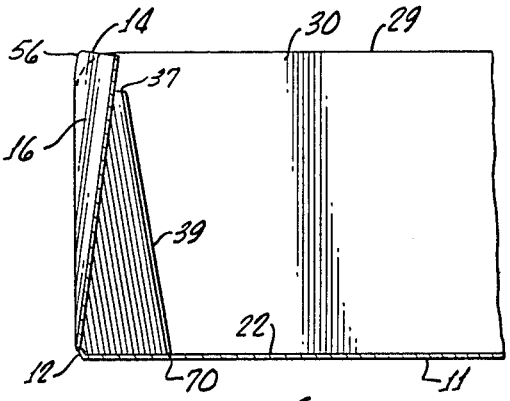
FIG. 10 is an enlarged fragmentary sectional view taken along line 10—10 of FIG. 8.
Figure 11:
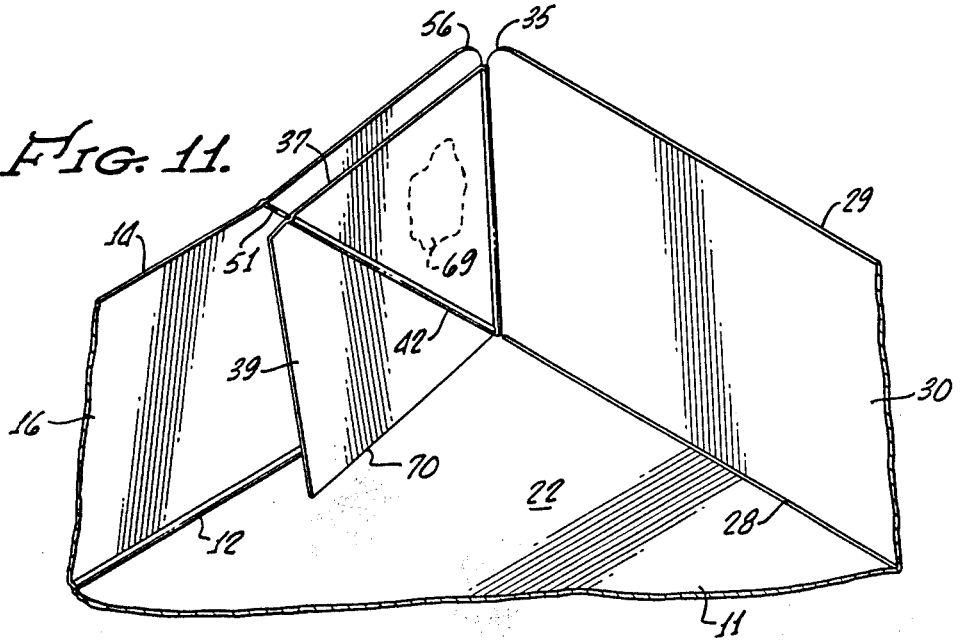
FIG. 11 is an enlarged fragmentary perspective view of a corner portion of the box unit in the unfolded condition.

Shown in FIG. 1 is a flat sheet 10 of cardboard which has been cut and scored in preparation for making a box of the type shown in U.S. Pat. No. 4,452,367. The surface that will become the inside of the completed box is viewed in FIG. 1. The sheet 10 includes a rectangular center panel 11 with scores along its side edges to enable bends to be made along straight lines so that the edge panels (i.e., the side and end panels) can be produced. This includes score lines 12 and 13 parallel to the longitudinal outer edges 14 and 15 of the sheet 10. This produces a relatively narrow strip 16 between the score 12 and the edge 14 for forming one of the side panels of the box upon completion. Similarly, the portion 17 between the score 13 and the opposite edge 15 provides for the other side panel. In conformance with conventional practice, the scores 12 and 13 are formed by means of a female steel rule die on the obverse side and a male steel rule die on the reverse side of the sheet 10. The resulting effect is as seen in the enlarged sectional view, FIG. 3, with a shallow groove 19 in what is reverse surface 20 as the board 10 is shown in FIG. 1, which is the surface that forms the outside of the completed box. A corresponding bead, or ridge, 21 protrudes from the surface 22 that defines the inside of the completed box.

Extending perpendicularly between the scores 12 and 13, and parallel and adjacent to one end edge 23, is a score 24. This is to provide a strip 25 that will produce one of the end panels of the completed box. Beyond the score 24, extending to the edges 14 and 15, are two cuts 26 and 27 through the entire thickness of the board.

The opposite end of the board is similar, including a score 28 adjacent, inwardly of and parallel to the opposite end edge 29 of the sheet 10. This produces a strip 30 to be used subsequently in forming an end panel of the completed box. Cuts 31 and 32, which also are parallel to the outer end edge 29, extend through the board beyond the scores 12 and 13, respectively.

Unlike conventional box construction, the scores 24 and 28 are reverse scores. Thus, they are arranged oppositely from the scores 12 and 13, providing a groove 33 in the surface 22 that will form the inside of the box and a protruding bead, or ridge, 34 on the outer surface 20 (see FIG. 4). The reason for forming the scores 24 and 28 in this manner is discussed below.

The end edge 29 terminates in two convexly rounded corners 35 and 36, which connect to shorter end edges 37 and 38 which are parallel to but inset relative to the edge 29. The parts bounded by the edges 37 and 38, being beyond the scores 12 and 13, respectively, provide end flaps 39 and 40 projecting from the strip 25. A score 42 extends across the end flap 39 at a 45° angle outwardly from the intersection of the scores 12 and 28 to the end edge 37. A similar diagonal score 43 extends across the end flap 40 from the juncture of the scores 13 and 28 to the edge 38.

The opposite end of the sheet 10 is identical, with rounded corners 44 and 45 at the ends of the edge 23 leading to end flaps 46 and 47. Diagonal scores 48 and 49 in the end flaps 46 and 47 are similar to the diagonal scores 42 and 43 in the end flaps 39 and 40.

A diagonal cut score 51 (a perforation with scores intermediate the cuts) diverges from the score 42, extending from adjacent the intersection of the scores 12 and 28 to the edge 14. A similar diagonal cut score 52 is divergent relative to the score 43 and extends from the intersection of the scores 28 and 13 to the edge 15. The cut scores 51 and 52 leave most of the material intact, with the cuts being approximately half the length of the spaces between them. In a typical example, the cuts are one-eighth inch long and the spaces one-fourth inch.

At the opposite end, there are similar diagonal cut scores 53 and 54 extending from the intersections of the score lines 12 and 13 with the score 24.

A convexly rounded corner 56 is provided opposite the cut score 51, connecting the longitudinal edge 14 and the cut 31. A corresponding convex rounded corner 57 connects the longitudinal edge 15 and the cut 32. A similar convexly rounded corner 58 connects the side edge 14 and the cut 26, and there is also a convexly rounded corner 59 extending from the opposite side edge 15 to the cut 27.

In order to provide an optional variable size box construction in accordance with my U.S. Pat. No. 4,452,367, a transverse score 61 extends from the side edge 14 to the side edge 15 at one side of the center of the sheet 10. An additional score 62, parallel to the score 61, interconnects the scores 12 and 13 on the opposite side of the center of the sheet 10. Perforations 63 and 64 form continuations of the ends of the score 62 and extend to V-shaped notches 65 and 66 in the side edges 14 and 15, respectively. The perforations 63 and 64 are to permit the board to be torn, as explained below, and the notches 65 and 66 facilitate initiation of the tears.

Additionally, diagonal perforations 67 and 68, to permit bending, extend respectively between the intersection of the scores 12 and 61 and the notch 65, and the intersection of the scores 13 and 61 and the notch 66.

After preparation of the sheet 10, as illustrated in FIG. 1, the next steps are to bend the sheet at the scores 12, 13, 24 and 28, glue the corner portions, and then fold the unit flat for shipment and storage, as illustrated in FIG. 5. This procedure is conventional. The end flaps 39 and 40 are folded inside of the side panels 16 and 17 prior to gluing. The space on the side panel 16 between the cut score 51 and the cut 31 then registers with the area on the end flap 39 between the diagonal score 42 and the end edge 37. These two areas are fastened together by glue 69. Similarly, on the opposite side of the box, the space between the diagonal cut score 52 and the cut 32 becomes superimposed upon the space between the diagonal score 43 and the end edge 38 of the end flap 40. These areas are glued. The opposite end of the box is glued in the same manner. The rounded corners 35 and 36 then are positioned next to each other, as are the corners 36 and 57. Similarly, the corner 44 then fits next to the corner 58, and the two corners 45 and 59 are brought together. These corners of the side and end panels provide the completed box units with recessed edge corners, as discussed below.

For folding the unit flat to the position of FIG. 5, bends are made at the diagonal cut scores 51, 52, 53 and 54. This enables the side panels 16 and 17 to be folded inwardly through 180° about the scores 12 and 13. The end panels 25 and 30 are folded 180° along the scores 24 and 28, and fit over the ends of the side panels. When this occurs, the end flaps 39 and 40 become located beneath the end panel 30, and the end flaps 46 and 47 are located beneath the end panel 25. This means that the edge 70 of the end flap 39 at the cut 31 and the edge 71 of the end flap 40 at the cut 32 become located at the base of the fold along the score 28. This is illustrated in FIG. 6 for the end flap 40. The edges of the end flaps 46 and 47 at the opposite end of the unit are, of course, then similarly positioned at the base of the fold around the score 24.

When the unit is opened for use as a box, as shown in FIG. 8, the end walls 25 and 30 and the side panels 16 and 17 are unfolded to an upstanding position. They are held in this position by the bottom edges of the end flaps, which then engage the upper surface of the center panel 11 within the scores 12, 13, 24 and 28. Thus, as seen in FIGS. 8–11, the outer corner of the edge 70 of the end flap 39 bears against the surface 22 of the panel 11, preventing the side panel 16 from collapsing inwardly about its bends at the cut score 51 and the score 12, as well as holding the end wall 30 in an upright position. The corresponding bottom edges of the other end flaps provide the same function.

The walls of a box constructed in accordance with this invention are more nearly perpendicular to the central panel 11 than are the walls of a box constructed conventionally. This results from the reverse scores 24 and 28 at the opposite end portions of the sheet 10. Because there is a groove 33 facing into the bend, extra clearance is generated beneath the end panel 30 to receive the end flaps 39 and 40. In other words, the bottom edges 70 and 71 of these two end flaps may be made to be in substantial alignment with the score 28, yet still find clearance to fit underneath the end panel 30 when the box is in the collapsed position of FIG. 5. The edge 70 is made to extend inwardly as far as possible at the base of the bend so that there is substantially no space between the edge 70 and the panel at the bend.

This may be contrasted with conventional construction, as shown in FIG. 7, in which the score is in the opposite direction, providing a ridge at the base of the bend. This results in a protrusion 21*a* at the base of the fold when the end panel is bent over, restricting the clearance for the lower edge 70*a* of the end flap 39*a*. Consequently, it is necessary to recess the lower edge 70*a* of the end flap 39*a*, as shown in FIG. 7, so that it will not interfere with the protruding ridge 21*a*. When the edge 70*a* is recessed in this manner, it will allow more inward bending of the sidewall, and also the end walls, before it engages the principal surface of the box to provide support for these walls. As a result, the conventional box is more difficult to use and less attractive than a box constructed in accordance with this invention.

Figure 12:
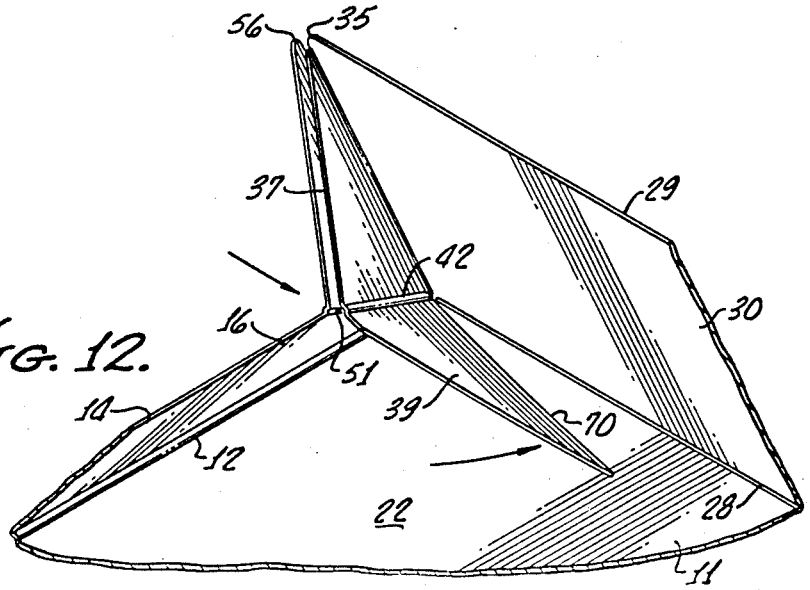
FIG. 12 is a view similar to FIG. 11, but illustrating the box unit in an intermediate stage as it is being returned to the folded position.
Figure 13:
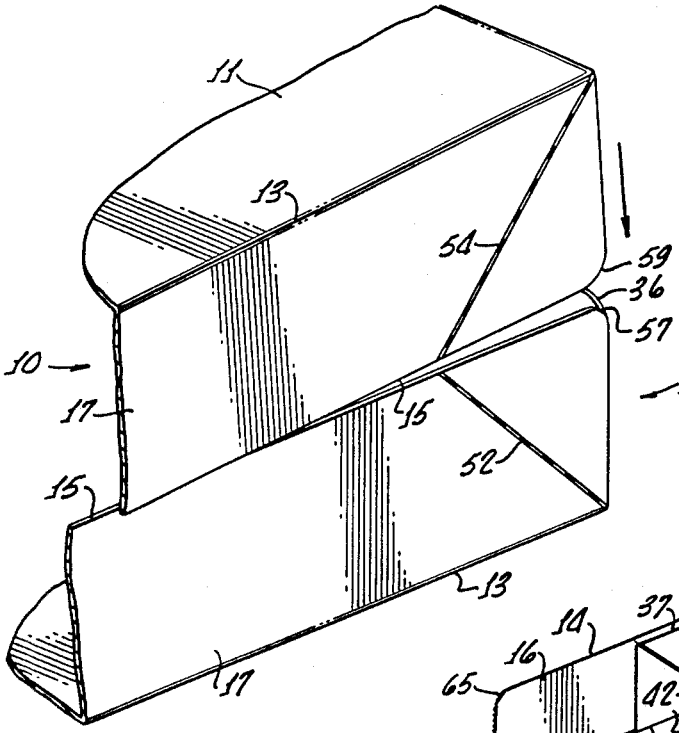
FIG. 13 is a fragmentary perspective view illustrating the assembly of two of the box units.
Figure 14:
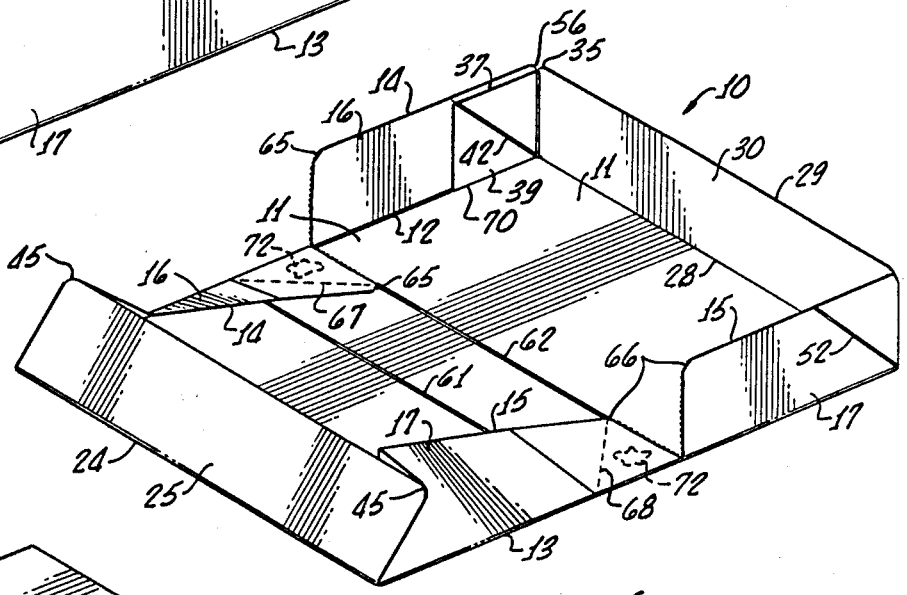
FIG. 14 is a perspective view of one of the box units as prepared for producing a relatively small sized box.
Figure 15:
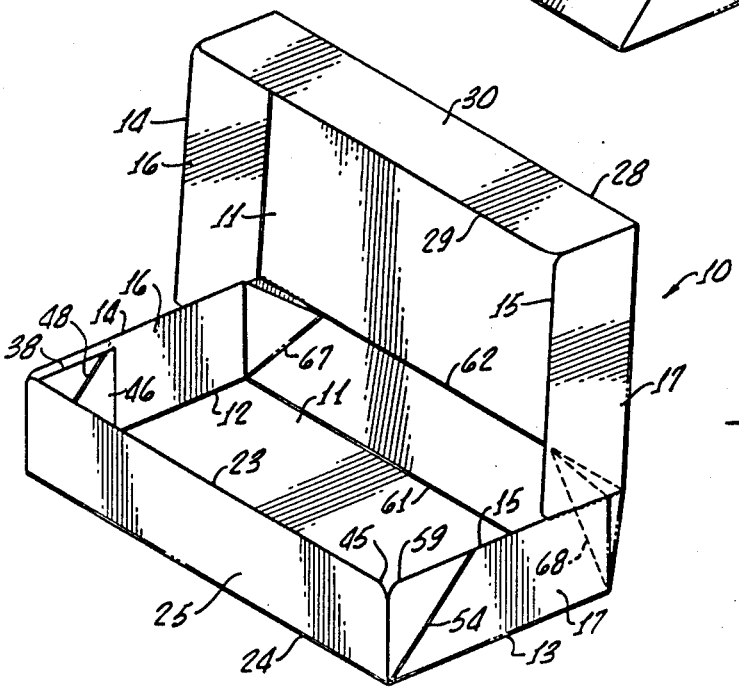
FIG. 15 is a perspective view of the completed relatively small sized box.

Occasionally, a box unit may be opened up to the position of FIG. 8, after which it is found that the box is not needed and so should be folded again to the position of FIG. 5 and returned to storage. When this is done, it is necessary to insert the end flaps underneath the end panels, which is not easily done with boxes of conventional design. Hence, all too often the end and side panels simply are bent down, creating bends in the end flaps as this is done, destroying their usefulness and, hence, that of the box. This will not occur with the present invention, because of the presence of the diagonal scores 42, 43, 48 and 49 on the end flaps 39, 40, 46 and 47. As shown in FIG. 12, when the side and end panels 16 and 30 are bent inwardly to their collapsed positions, the end flap 39 will be caused to deflect around its diagonal score 42. This causes the bottom portion of the end flap to slide readily across the surface 22 of the central panel 11 of the box and enter the space beneath the end panel 30.

The rounded corners on the side and end panels facilitate assembly of two box sections to form a base and a lid of a completed box. When one box section is fitted over the other, the rounded corners allow them to slide easily together without obstruction. In the absence of such corners, one box section tends to catch on the other at the corners.

As part of the optional variable-size box construction of my previous U.S. Pat. No. 4,452,367, each of the side panels 16 and 17 is secured to the center panel 11 by a drop of glue 72. This is simply torn apart when the panels 16 and 17 are unfolded if a full sized box is to be formed. However, when a relatively small box is to be made from one of the units, glued connections are left intact and the side panels 16 and 17 are torn along the perforations 63 and 64. The unit then is bent about the transverse scores 61 and 62, as well as the diagonal perforations 67 and 68, so that it forms a lid attached to the base of a smaller box. The tear of the side panels along the perforations is more easily accomplished, and there is greater assurance that it will be made accurately, through the use of the notches 65 and 66 in the edges 14 and 15. One can tell exactly where the tear is to be made by the presence of the notches 65 and 66 and, in fact, feel these locations so that the tear can be accomplished entirely by the sense of touch, without even looking at the box.

The foregoing detailed description is to be clearly understood as given by way of illustration and example only, the spirit and scope of this invention being limited solely by the appended claims.

What is claimed is:

1. A folding box unit formed from an initially flat sheet of bendable material comprising a central panel, integral edge panels connected to said central panel, and integral end flaps projecting from certain of said edge panels and being connected to others of said edge panels, said end flaps having free bottom edges, means at the juncture of each of said edge panels and said central panel for causing a straight line bend, said sheet having a first position in which it is bent about said means for causing a straight line bend so that said edge panels overlie said central panel on one surface of said sheet and said end flaps are beneath the ones of said edge panels from which they project, with said free bottom edges of said end flaps adjacent said means for causing a straight line bend, said sheet having a second position in which it is unfolded about said means for causing a straight line bend so that said edge panels are upstanding relative to said central panel and said bottom edges of said end flaps engage said central panel for supporting said edge panels in said upstanding positions thereof, said means for causing a straight line bend at locations which are adjacent said end flaps when said sheet is in said first position being defined by a reverse score which, when said sheet was so initially flat, provided a groove in said one surface of said sheet and a corresponding ridge on the opposite surface thereof, whereby there is no protrusion from said reverse score at the base of the bend at said locations, said free bottom edges of said end flaps being in juxtaposition with said reverse score at said locations with substantially no space therebetween, whereby when said sheet is in said second position said end flaps support said edge panels in relatively close to a perpendicular relationship relative to said central panel.

2. A device as recited in claim 1 in which said reverse scores extend the full length of the juncture between said certain edge panels and said central panel.

3. A device as recited in claim 1 in which said end flaps are generally rectangular.

4. A device as recited in claim 1 in which each of said end flaps is substantially rectangular, and including means for providing a straight line bend extending from adjacent the juncture of said bottom edge of each of said end flaps and the one of said edge panels from which it projects diagonally outwardly so as to diverge from said bottom edge, for providing a means for deflecting portions of said end flaps and facilitating movement from said second position to said first position of said sheet without damaging said end flaps.

5. A device as recited in claim 4 in which said last mentioned means for providing a straight line bend comprises a score in said sheet.

6. A device as recited in claim 1 in which said edge panels when so upstanding when said sheet is in said second position provide an outer edge for said sheet and corners between adjacent ones of said edge panels, said outer edge at said corners being tapered inwardly for facilitating the telescoping of one of said sheets relative to another of said sheets to form an enclosed box.

7. A device for making a box comprising an integral sheet of bendable material including a flat rectangular bottom panel, a first pair of edge panels positioned one along each of two opposite edges of said bottom panel, a second pair of edge panels positioned one along each of the other two opposite edges of said bottom panel, a first means for providing for a straight bend line along said first two opposite edges of said bottom panel, said first means comprising a score providing a ridge along one side of said sheet and a groove in the opposite side of said sheet opposite from said ridge, a second means for providing for a straight bend line along said other two opposite edges of said bottom panel, each of said second pair of edge panels including opposite ends and an end flap projecting from each of said opposite ends thereof, a third means for providing for a straight bend line transversely of said second pair of edge panels at the junctures thereof with said end flaps, said end flaps overlapping said first pair of edge panels on said one side of said sheet, adhesive means attaching said end flaps to said first pair of edge panels at the outer end portions of said first pair of edge panels and at the inner end portions of said end flaps, a fourth means for providing for a straight bend line diagonally along each of said first pair of edge panels at the end portions thereof inwardly of said adhesive means, said first pair of edge panels being bent substantially 180° about said first means for providing a straight bend line and said second pair of edge panels being bent substantially 180° about said second means for providing a straight bend line, so that said first and second pairs of said edge panels overlie said bottom panel, and the outer ends of said second pair of edge panels overlie the outer ends of said first pair of edge panels, said end flaps being bent substantially 180° about said third means for providing for a straight bend line and said first pair of edge panels being bent substantially 180° about said fourth means for providing for a straight bend line so that said end flaps are positioned beneath the ones of said second pair of edge panels from which they project, said second means for providing for a straight bend line along said other two opposite edges including a reverse score opposite from said end flaps, each of said reverse scores providing a ridge along said opposite side of said sheet and a groove opposite from said ridge in said one side of said sheet prior to when said second pair of edge panels is so bent substantially 180°, whereby there is substantially no lateral protrusion along said one side of said sheet at said reverse scores upon said bending of said second pair of edge panels, said end flaps having bottom edges in juxtaposition with said reverse score so as to leave substantially no space therebetween, said panels being movable to upstanding positions relative to said bottom panel, whereby said bottom edges of said end flaps engage said bottom panel and provide for support for said edge panels, preventing collapse thereof inwardly toward said bottom panel.

8. A device as recited in claim 7, in which said reverse score extends the full length of said other two opposite edges.

9. A folding box unit comprising an integral sheet of bendable material including a central panel, a plurality of edge panels connected to said central panel, at least one end flap projecting from certain of said edge panels and being connected to another of said edge panels, said end flaps having free bottom edges extending from said certain edge panels, means at the juncture of each of said edge panels and said central panel for causing a straight line bend, means for providing a straight line bend transversely of said certain edge panels at the junctures between said certain edge panels and said end flaps, said sheet having a first position in which it is bent about each of said means for causing a straight line bend so that said edge panels overlie said central panel on one surface of said sheet and said end flaps are beneath said certain edge panels, said sheet having a second position in which it is unfolded about said means for causing a straight line bend so that said edge panels are upstanding relative to said central panel and said bottom edges of said end flaps engage said central panel for supporting said edge panels in said upstanding positions thereof, and an additional means for causing a straight line bend diverging outwardly from said bottom edge of each of said end flaps from adjacent the juncture of said bottom edge and the one of said edge panels from which it projects, for providing a means for deflecting portions of said end flaps and facilitating movement of said sheet from said second position to said first position thereof without damaging said end flaps.

10. The method of producing a unit for making a box comprising the steps of providing a flat sheet of bendable material, forming in said sheet means for obtaining straight line bends therein so as to define a central panel and edge strips around the periphery thereof, providing end flaps projecting from the ends of certain of said edge strips and adjacent others of said edge strips, bending said sheet substantially 180° about said means for obtaining straight line bends so that said edge strips overlie said central panel along one surface of said sheet, attaching said end flaps to said other edge strips so that said end flaps have free bottom edges, bending said end flaps inwardly so that when said edge strips so overlie said central panel each of said end flaps is in a position beneath the edge strip from which it projects, and said bottom edges are adjacent said means for obtaining straight line bends, and unfolding said sheet so that said edge strips are upstanding relative to said central panel and said bottom edges of said end flaps engage said central panel and provide support for said edge strips so as to maintain the same in said upstanding position, said means for obtaining straight line bends at locations which are opposite said bottom edges when said end flaps are so bent inwardly being formed as a reverse score in which a groove is created in said one surface and a corresponding ridge is formed on the opposite surface of said sheet, whereby said means for obtaining straight line bends at said locations does not protrude between said edge strips and said central panel at said locations, said bottom edges being positioned in juxtaposition with said reverse score with substantially no space therebetween when said end flaps are so bent inwardly, whereby said bottom edges can so support said edge strips in a position relatively close to perpendicular relative to said central panel when said sheet is so unfolded.

11. A folding box unit providing a central panel with edge panels upstanding around the periphery thereof and supported in a relatively perpendicular relationship relative to said central panel made by the steps of providing a flat sheet of bendable material, forming in said sheet means for obtaining straight line bends therein so as to define a central panel and edge strips around the periphery thereof, providing end flaps projecting from the ends of certain of said edge strips and adjacent others of said end strips, bending said sheet substantially 180° about said means for obtaining straight line bends so that said edge strips overlie said central panel along one surface of said sheet, attaching said end flaps to said other edge strips so that said end flaps have free bottom edges, bending said end flaps inwardly so that when said edge strips so overlie said central panel each of said end flaps is in a position beneath the edge strip from which it projects, and said bottom edges are adjacent said means for obtaining straight line bends, and unfolding said sheet so that said edge strips are upstanding relative to said central panel and said bottom edges of said end flaps engage said central panel and provide support for said edge strips so as to maintain the same in said upstanding position, said means for obtaining straight line bends at locations which are opposite said bottom edges when said end flaps are so bent inwardly being formed as a reverse score in which a groove is created in said one surface and a corresponding ridge is formed on the opposite surface of said sheet, whereby said means for obtaining straight line bends at said locations does not protrude between said edge strips and said central panel at said locations, said bottom edges being positioned in juxtaposition with said reverse score with substantially no space therebetween when said end flaps are so bent inwardly, whereby said bottom edges can so support said edge strips in a position relatively close to perpendicular relative to said central panel when said sheet is so unfolded.

* * * * *